US005794682A

United States Patent [19]

Damasse et al.

[11] Patent Number: 5,794,682

[45] Date of Patent: Aug. 18, 1998

[54] NOZZLE PLANT EQUIPPED WITH SUCH A NOZZLE, FOR THE CONTINUOUS CASTING OF METAL PRODUCTS

[75] Inventors: Jean-Michel Damasse, Isbergues; Jacques Barbe, Saint Etienne, both of France

[73] Assignee: Usinor Sacilor (Societe Anonyme), Puteaux, France

[21] Appl. No.: 739,994

[22] Filed: Oct. 30, 1996

[30] Foreign Application Priority Data

Nov. 23, 1995 [FR] France ..... 95 13903

[51] Int. Cl.[6] ..... B22D 11/14; B22D 41/60

[52] U.S. Cl. ..... 164/437; 222/606

[58] Field of Search ..... 164/437, 473; 222/606, 607; 266/216, 236

[56] References Cited

U.S. PATENT DOCUMENTS

| | | | |
|---|---|---|---|
| 3,672,431 | 6/1972 | Bryson | 164/437 X |
| 3,738,419 | 6/1973 | Hartmann et al. . | |
| 4,531,569 | 7/1985 | Fritscher | 164/485 X |

FOREIGN PATENT DOCUMENTS

| | | | |
|---|---|---|---|
| 2659880 | 9/1991 | France . | |
| 53-7374 | 3/1978 | Japan | 164/437 |
| 57-103762 | 6/1982 | Japan | 164/437 |
| 63-76752 | 4/1988 | Japan | 222/606 |
| 63-76753 | 4/1988 | Japan | 222/606 |
| 63-132754 | 6/1988 | Japan | 164/437 |
| 1016051 | 5/1983 | U.S.S.R. | 164/437 |
| 1047582 | 10/1983 | U.S.S.R. | 164/437 |
| 2187404 | 9/1987 | United Kingdom . | |
| WO88/06932 | 9/1988 | WIPO . | |
| WO89/12519 | 12/1989 | WIPO . | |

OTHER PUBLICATIONS

Abstract of Japanese Patent Publication 60–221154 Published Nov. 5, 1985.

Abstract of U.S.S.R. Inventor's Certificate 716704 Published Feb. 28, 1980.

*Primary Examiner*—J. Reed Batten, Jr.

*Attorney, Agent, or Firm*—Sixbey Friedman Leedom & Ferguson; Thomas W. Cole

[57] ABSTRACT

The nozzle includes a chimney whose upper end is connected to the output nozzle of a vessel containing liquid metal and whose lower end is connected to a terminal part of the nozzle provided with outlets for distributing liquid metal into the casting space defined by the mold. The terminal part includes, in its upper region, at least one opening for allowing the reheating of the inside of the terminal part by a burner. The nozzle is particularly adapted for use with a bottomless mold having intensively internally cooled walls, and is preferably made of a refractory material.

15 Claims, 3 Drawing Sheets

NOZZLE PLANT EQUIPPED WITH SUCH A NOZZLE, FOR THE CONTINUOUS CASTING OF METAL PRODUCTS

FIELD OF THE INVENTION

The invention relates to the continuous casting of metals, especially of steel. More precisely, it relates to the tubes of refractory material called "nozzles" which, usually, are connected via their upper end to the tundish serving as reservoir of liquid metal, and the lower end of which is submerged in the pool of liquid metal contained in the mold in which the metal product starts to solidify. The primary role of these nozzles is to protect the stream of liquid metal as it travels between the vessel and the mold from atmospheric oxidation. They also make it possible, by virtue of appropriate configurations of their lower end, to direct in a favorable manner the flows of liquid metal in the mold so that solidification of the product occurs under the best possible conditions.

PRIOR ART

Casting may take place in a mold which is to confer on the product a cross section of highly elongate rectangular shape, for which reason the product is usually denoted by the term "flat product". This is the case when, in steelmaking, the steel is cast in the form of slabs, that is to say of products having a width of approximately 0.6 to 3 m and a thickness which is generally of about 20 cm but which may be as low as a few cm in certain recent plants called "thin-slab casters". In these examples, the mold is composed of fixed copper or copper-alloy walls which are intensively cooled on their cold face which is not in contact with the metal. Experiments have also been carried out with plants making it possible to obtain, by direct solidification of the liquid metal, steel strip a few mm in thickness. To do this, molds are used whose casting space is delimited on its long sides by a pair of internally cooled rolls, having parallel horizontal axes and rotating about these axes in opposite directions, and on its short sides by closure plates (called side walls) made of refractory material which are applied against the ends of the rolls. The rolls or the side walls may also be replaced by cooled endless belts.

In order to procure orientations favorable to the flows of metal in the mold, the terminal lower part of the nozzle sometimes has a complex shape, which is elongate in a direction parallel to the long sides of the casting space. It therefore occupies a major proportion of this space, particularly in the case of twin-roll casting of thin products. It also represents a mass of refractory material which must necessarily be carefully preheated before casting, in order to avoid the risk of the metal freezing inside or around the nozzle at the start of the cast. This is even more true when the nozzle is, on its inside, equipped with obstacles which locally restrict its cross section so as to impose on the metal head losses which stabilize its flow. In addition, for security, in order to prevent such freezing during the cast should the temperature of the metal in the tundish drop appreciably (especially in the final minutes of the cast), it is often necessary to cast the metal at a temperature greater than that which would be metallurgically desirable in order to obtain a product of the highest quality. Provision may also be made to reheat the metal present in the tundish, in order to keep its temperature constant throughout the cast, by virtue of an induction device or a plasma torch. However, these devices are expensive in terms of plant costs and running costs, in that they complicate the construction of the casting plant and consume a great deal of energy. It has also been proposed to incorporate in the nozzle heater elements in the form of electrical resistors, which may act during the cast itself. However, this singularly complicates the construction and use of the nozzle (see document JP 1-228649).

The object of the invention is to propose to users a type of nozzle and a casting plant incorporating it which make it possible to overcome, to a large extent, the thermal problems which have just been mentioned, without having to complicate excessively the construction and use of the nozzle.

SUMMARY OF THE INVENTION

With these objectives in mind, the subject of the invention is a nozzle for introduction of a liquid metal into a mold for the continuous casting of metal products, of the type including a chimney whose upper end is intended to be connected by fixing means to the output nozzle of a vessel containing said liquid metal and whose lower end is connected to a terminal part of the nozzle provided with outlets which are intended to distribute said liquid metal in the casting space defined by said mold, wherein said terminal part includes, in its upper region, at least one opening intended to allow reheating of the inside of said terminal part by heating means, such as a burner.

The subject of the invention is also a plant for the continuous casting of metal products, of the type including a bottomless mold having intensively internally cooled walls defining a casting space, and a nozzle made of refractory material which is connected via its upper end to a vessel containing a liquid metal, and the lower end of which feeds said liquid metal into said casting space, wherein said nozzle is of the previously described type.

This plant may especially be a plant for casting conventional slab or a plant for casting thin strip, directly from liquid metal, such as twin-roll casting.

As will have been understood, the invention consists in providing a nozzle with at least one opening allowing passage of a device such as a burner which can heat the inside of the nozzle. When, as is often preferable, several burners are employed, a corresponding number of openings must be provided. These burners may, if necessary, also act well before the cast. The openings must, during the cast, be held permanently above the level of liquid metal and may also be used to introduce addition elements in minor amounts into the liquid metal, by profiting, if necessary, from the action of the burners in order to compensate for the heat losses due to this addition. It is also possible, at the start of the cast, to introduce into the metal, by virtue of these openings, an exothermic powder promoting the start-up of casting or the melting of spurious solidifications which thus become temporary. In order for this type of nozzle to be used effectively, it is essential to prevent air from being able to pass through these openings and contaminate the metal inside the nozzle. It is therefore, for this purpose, highly recommended to enclose at least the lower part of the nozzle under a cap which also protects the environment of the mold. The invention is particularly suitable for the case in which the nozzle has, in its lower part, a flared and elongate shape, this lower part being intended to be directed so as to be parallel to the long sides of the mold.

BRIEF DESCRIPTION OF THE DRAWINGS

The invention will be more clearly understood on reading the description which follows, with reference to the following appended figures.

DESCRIPTION OF THE PREFERRED EMBODIMENTS

Figure 1A:
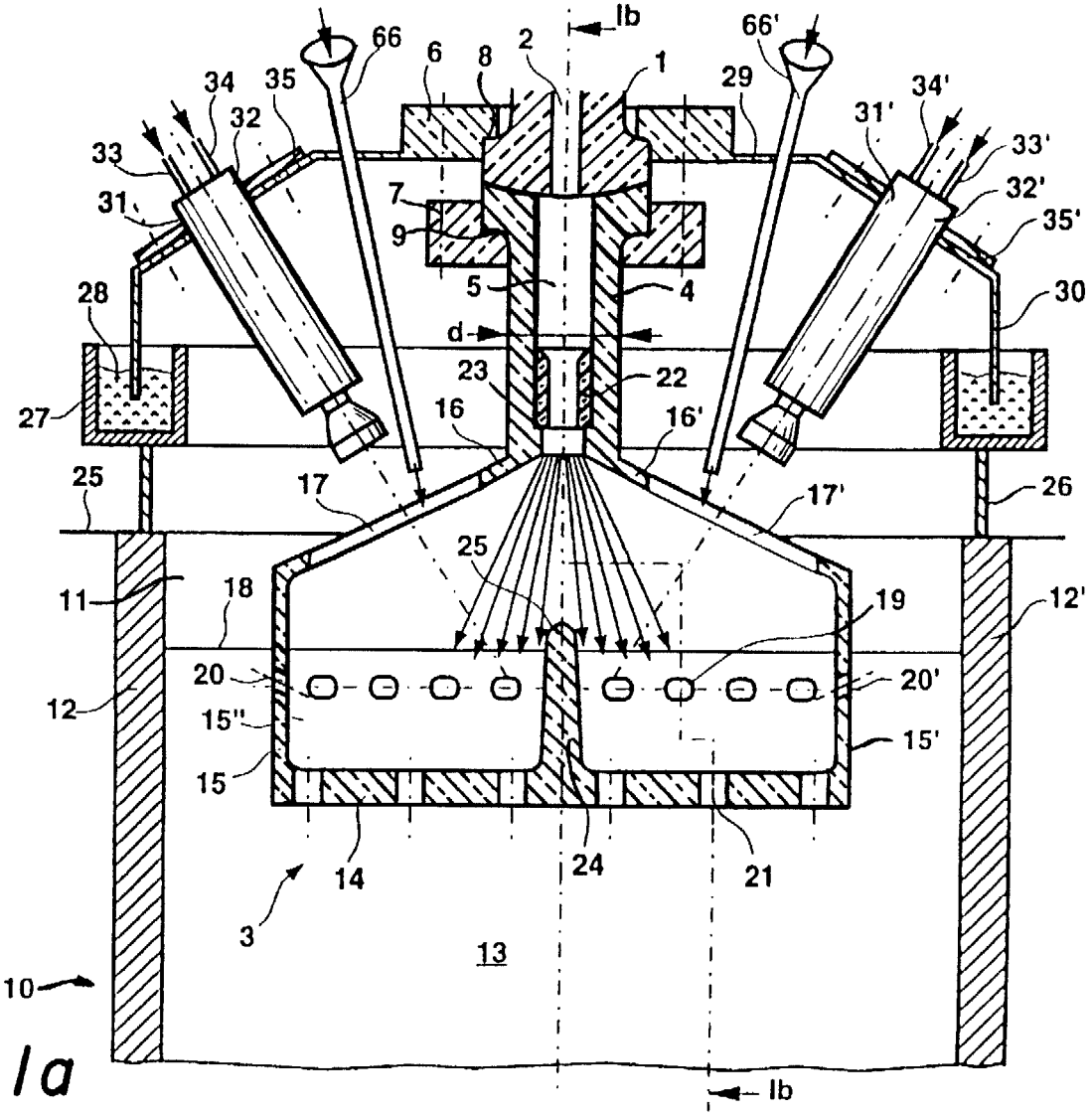
FIGS. 1*a* and 1*b* which show, seen in section on Ia—Ia and Ib—Ib respectively, an example of a nozzle according to the invention, as well as the mold and the environment of the mold of the continuous slab caster thus equipped.
Figure 1B:
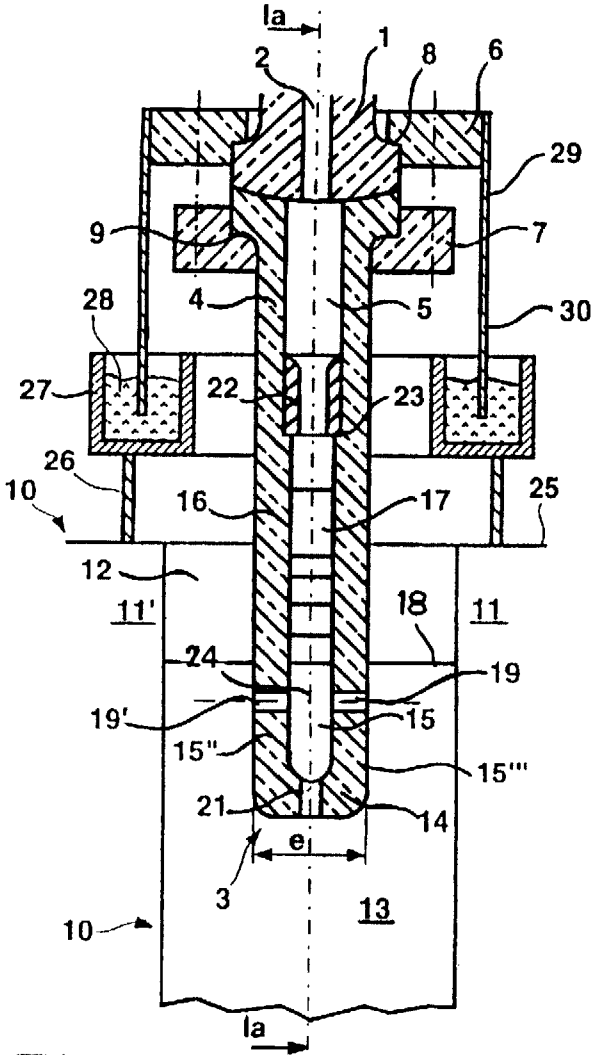

The illustrative embodiment depicted in FIGS. 1*a* and 1*b* relates to the continuous casting of conventional steel slab, having a thickness of about 20 cm and a width of between approximately 0.6 and 3 m. The casting plant comprises a reservoir of liquid metal called "tundish", this not being depicted. The liquid steel flows out of the tundish, at a rate which can be controlled by the operator, through an outlet made in the bottom of the tundish. This outlet is extended by a tubular output nozzle 1 made of refractory material, such as graphitized alumina, the internal space 2 of which is cylindrical and to which is connected a nozzle 3 of a type according to the invention. This nozzle 3 is made of a refractory material similar to the previous one, or made of a different material whose nature takes account of the constructional constraints of the nozzle 3 or of the physico-chemical conditions prevailing in the mold. It is composed of two parts, these being made as a single piece in the example depicted.

The first part is a chimney 4 which has a cylindrical overall external shape, of diameter "d", and the cylindrical internal space 5 of which extends that of the output nozzle 1 and has the same diameter or preferably a slightly greater diameter, so that any slight misalignment in the two spaces 2 and 5 is of no consequence for the flows of metal. The connection between the output nozzle 1 and the chimney 4 of the nozzle 3 must be sealed as well as possible in order to avoid creating a draught of ambient air getting into the nozzle 3. In the example depicted, this connection is achieved by fixing one or other by means, not depicted, of an upper bush 6 and a lower bush 7 which bear on bearing surfaces 8, 9 made respectively at the lower end of the output nozzle 1 and at the upper end of the chimney 4.

The functions of the second part of the nozzle 3, called the terminal part, are to receive the liquid steel leaving the chimney 4 and to distribute it in the casting space defined by the mold 10. This mold 10, which, as depicted in FIGS. 1*a*, 1*b*, is designed for casting steel slab of conventional format, has, as usual, two long sides 11, 11' and two short sides 12, 12' formed by copper or copper-alloy walls intensively internally cooled, on which walls the liquid metal starts to solidify. It gives the casting space 13 a rectangular cross section which is constant over its entire height. Below the chimney 4, the nozzle 3 has a constant thickness "e" equal to the external diameter "d" of the chimney 4, or scarcely different from it. Seen in vertical longitudinal section, the terminal part of the nozzle 3 has a pentagonal shape: when the nozzle 3 is in place, the bottom 14 is substantially horizontal, the lateral walls 15, 15', 15", 15'" are substantially vertical, these lateral walls being connected at the lower end of the chimney 4 by the oblique walls 16, 16'.

According to the invention, these oblique walls 16, 16' each include an opening 17, 17'. The function of these openings 17, 17' will be explained later; but they do not, in principle, have any role in the introduction of the liquid metal into the casting space 13. This introduction is normally provided by series of outlets which are made in the bottom 14 and the lateral walls 15, 15', 15", 15'" of the nozzle 3 and which are located so as always to lie below the level 18 of the surface of the liquid metal in the mold under normal casting conditions. A first series of outlets 19, 19' is made in the lateral walls 15", 15'" which face the long sides 11, 11' of the mold 10. They produce streams which must preferentially feed the meniscus, that is to say the region of contact between the surface of the liquid metal and the mold 10, supplying thereto the quantity of heat necessary to prevent the spurious solidifications and to melt the coverage powder usually deposited on the surface. For this purpose, these outlets 19, 19' are distributed over the entire width of the walls 15', 15'" and may be directed horizontally or be inclined so as to direct the liquid metal which passes through them towards the meniscus. A second series of outlets 20, 20' is made in the lateral walls 15, 15' which face the short sides 12, 12' of the mold 10. There is generally one outlet per wall 15, 15' because of the narrow width of the latter. They have the same function as the outlets 19, 19' of the first series. Their positions, dimensions and orientations must, in addition, be determined so that they do not send into the corners of the mold 10 a quantity of hot metal which could promote partial remelting of the shell of solid metal formed thereat. Such weakening of the shell, should it go as far as rupturing it, could cause serious casting incidents (break-outs). A third series of outlets 21 is made in the bottom 14, so as to feed the lower part of the casting space 13 with hot metal. In the example depicted, these outlets 21 are directed vertically, but it is conceivable to direct them obliquely, if this appears to be useful. Provision may also be made to arrange them in several rows, distributed on either side of the longitudinal mid-plane Ia—Ia of the nozzle.

In the example depicted, the nozzle 3 also includes, advisedly but not necessarily, an insert 22 placed in a housing 23 inside the chimney 4, which locally restricts the internal space 5 of the chimney 4. This local restriction has the effect of causing the metal to lose some of its energy, which leads to better filling of the entire internal space of the nozzle 3 and all of its outlets 19, 19', 20, 20', 21. The metal thus flows out of the nozzle 3 more uniformly, which is favorable to the quality of the metal cast. This insert 22 may, as depicted, have the shape of a tubular element having a diameter smaller than that of the chimney 4, but it is possible to confer on it other shapes, for example that of a stack of perforated discs. It is also possible to place it at the upstream or downstream end of the chimney 4. Moreover, still with the purpose of ensuring greater uniformity of the flows, a partition 24 has been provided on the bottom 14 of the nozzle 3, this partition lying vertically in line with the chimney 4 and being intended to break up and separate into two streams the jet of liquid metal flowing into the lower part of the nozzle 3. This partition 24 therefore divides the internal space of the terminal part of the nozzle 3 into two compartments, each having an opening 17, 17' in the top.

The plant is completed by a device providing protection of the space around the mold 10 from the ambient atmosphere. The use of such a device is not indispensable in a conventional slab-casting plant since the liquid steel in it is protected from the atmosphere by the entirely closed nozzle and by the coverage powder. However, the openings 17, 17' in the nozzle 3 according to the invention expose the internal space of the nozzle 3 to the ambient atmosphere, and it is therefore particularly important to render this atmosphere inert in order to prevent oxidation of the metal. For this purpose, in the example depicted, the rim 25 of the mold 10 includes, right around its perimeter, a collar 26 supporting a channel 27 containing a sealing material such as sand 28. A cap 29 fastened to the upper bush 6, and therefore to the tundish, delimits the space above the mold 10, and its lower part is formed by a vertical dropping edge 30 which is submerged in the sand 28 in the channel 27, which thus behaves as a seal allowing the cap 29 a degree of vertical movement. The latter may therefore follow the upward and downward motions of the tundish and of the nozzle 3, by virtue of which it is possible to adjust the depth of immersion of the nozzle 3 in the liquid steel, without the inerting of the environment of the mold 10 being affected thereby. This vertical movement is also compatible with the vertical oscillatory motions which are conventionally imposed on he mold. Such a way of providing this sealing is known per se and, of course, is not the only possible way. Among its advantages, mention may be made of the fact of including under the cap 29 the region of connection between the output nozzle 1 of the tundish and the chimney 4 of the nozzle 3, and therefore of minimizing the consequences of any sealing defect in this connection.

According to the invention, the cap 29 is pierced by two openings 31, 31' whose dimensions and positions make it possible to insert therein two burners 32, 32' which are directed towards the openings 17, 17' made in the nozzle 3. In this way, it is possible for these burners to reheat the liquid metal when it is actually inside the nozzle 3, each burner 32, 32' being responsible for one half of the nozzle 3. The use of a single burner 32, 32' would be conceivable, but it is clear that the homogeneity of the reheating is better if there are two of them, in particular if the partition 24 physically separating the internal space of the terminal part of the nozzle 3 in the two compartments is used. Each of these burners includes a combustible-gas inlet 33, 33' and an oxidant-gas inlet 34, 34'. This oxidant may be oxygen, or preferably air, since defective control of the oxidant flow rate which would result in incomplete consumption thereof would cause less oxidation, both of the metal and of the refractories. The use of plasma torches, for example, is also conceivable. Each of these burners 32, 32' is fitted with a collar 35, 35' which makes it possible to close off in a sealed manner the opening 31, 31' passing through the cap 29. The collar 35, 35' is, for this purpose, fixed to the cap 29 by means which are not depicted. There is also the possibility of using the burners 32, 32' only during the phase of preheating the nozzle 3, during which phase they preheat the inside of the nozzle 3 particularly effectively. During the cast, they may either be left in place, possibly by using them to blow in a neutral gas under the cap 29, above the casting space, or be removed and replaced by sealed covers isolating the casting space from the external air. By combining these burners 32, 32' with other burners heating the terminal part of the nozzle 3 from the outside, it is possible to achieve excellent preheating of the entire nozzle 3, including its internal space. After this preheating, the tundish/nozzle 3/cap 29 assembly is brought over the mold 10, the height of the tundish is adjusted so as to give the nozzle 3 its nominal depth of immersion in the mold 10 and the cast commences. It is thus possible for this internal space to have a complex configuration by arranging therein a wide variety of shapes of refractory elements (such as the partition 24) intended to improve the hydrodynamic behavior of the liquid metal, without these elements causing, at casting start-up, excessive heat losses which could lead to the metal freezing inside the nozzle 3.

Should there be partial or total blockage of the outlets 19, 20, 20', 21, which would cause the output of metal able to flow out of the nozzle 3 to be insufficient, and should the device for protection against the ambient atmosphere allow sufficient vertical movement of the nozzle 3, the latter may possibly be submerged more deeply into the mold so that the openings 17, 17' become at least partially submerged and also contribute to feeding the mold with liquid metal. In this way, it is possible to continue the cast, even under worse conditions than the normal conditions.

This arrangement also applies to the casting of thin slabs, the thickness of which, at the exit of the mold, is, for example, from 5 to 7 cm. In plants for casting such products, the molds have either parallel plane faces 2 by 2, or faces which converge towards the exit of the mold, or combined plane/concave faces. In all these cases, the nozzle 3 is designed to match the horizontal contour of the casting space 13.

Figure 2A:
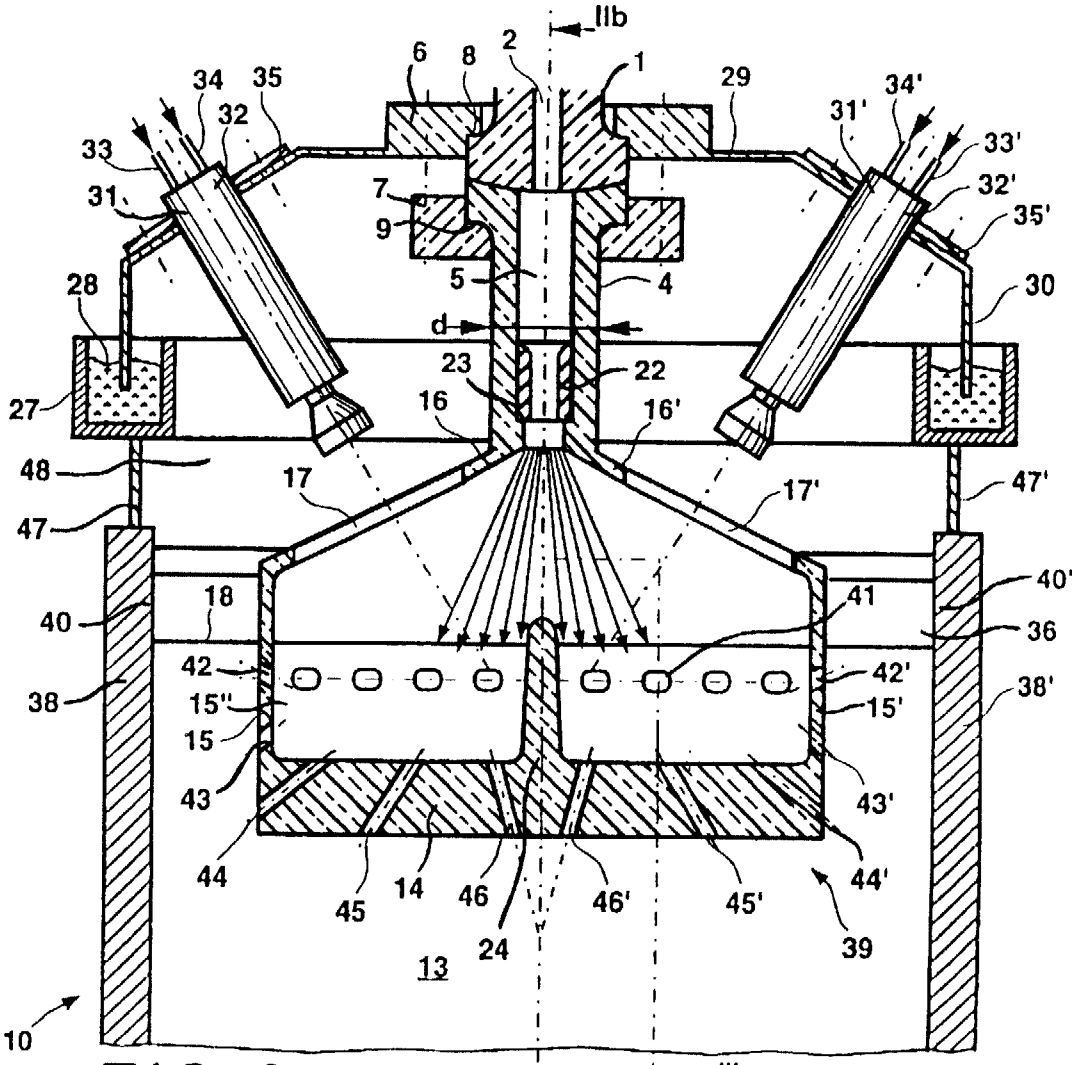
FIGS. 2*a* and 2*b* which show, seen in section on IIa—IIa and IIb—IIb respectively, an example of a nozzle in accordance with the invention, as well as the mold and the environment of the mold of the twin-roll thin strip caster thus equipped.
Figure 2B:
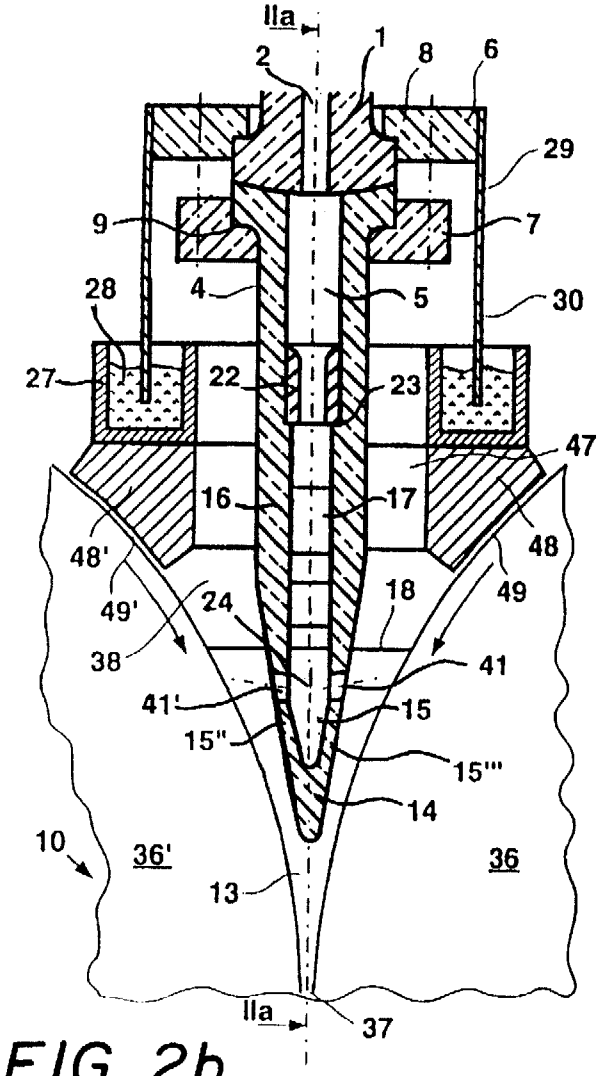

FIGS. 2*a*, 2*b* depict another illustrative embodiment of the invention, applied to the casting of thin sheet, having a thickness of about a few mm, when this casting is carried out between two intensively cooled rolls. The devices which are common both in their function and in their configuration between this example and that depicted in FIGS. 1*a*, 1*b*, are identified therein by the same references. The casting space 13 of the mold is, as known, formed by two closely spaced rolls 36, 36', having horizontal axes and rotating in opposite directions about their axes. They are intensively cooled internally so that solidification of the cast product starts on their outer surfaces, forming solidified shells which join up in the neck 37, that is to say at the point where the rolls are closest together, in order to form the cast strip. The liquid metal, such as steel, is confined laterally in this casting space by refractory side walls 38, 38' applied against the edges 40, 40' of the rolls 36, 36'.

The nozzle 39 according to the invention, depicted in FIGS. 2*a*, 2*b*, differs from that depicted in FIGS. 1*a*, 1*b* with respect to the following points, which render it suitable for use in twin-roll casting:

- its terminal part, instead of having a substantially constant thickness "e", gradually narrows down from top to bottom so as to match the shape of the casting space 13;
- the various outlets made in this terminal part, for introduction of the liquid metal into the casting space 13, are distributed somewhat differently, it being understood that here, too, this distribution is merely a nonlimiting example.

A first series of outlets 41, 41' is made in the lateral walls 15", 15'" of the nozzle 39 which face the rolls 36, 36'. They are distributed over as great a width as possible. In particular if, as depicted, they are directed upwards, they preferentially feed the region of first contact between the liquid metal and the roll to which they are close and supply thereto the quantity of heat necessary to prevent the spurious solidifications. A second series of outlets 42, 42' is made in the lateral walls 15, 15' of the nozzle 39 which face the side walls 38, 38' confining the casting space 13. These may also direct the flows of liquid metal upwards. Preferably, they also preferentially feed hot metal to the corners of the casting space 13 which are formed by the edges of intersection between the rolls 36, 36' and the side walls 38, 38', since these regions tend to cool more than the rest of the casting space 13. This cooling may produce several negative effects, such as solid infiltrations between roll and side wall. Further outlets 43, 43', 44, 44', 45, 45', 46, 46' are drilled through the lateral walls 15, 15' and/or the bottom 14 of the nozzle 39, and direct the liquid metal which exits therefrom towards the casting space 13, rather more towards the side walls 38, 38' in the case of the outlets 43, 43', 44, 44', 45, 45' and rather more towards the neck 37 in the case of the outlets 46, 46'. It goes without saying that the configuration which has just been described is only a nonlimiting example, the number, distribution and orientation of the outlets in the nozzle 39 possibly being different depending on the precise configurations of the nozzle 39 and of the casting space 13.

As in the previous example, a cap 29 is provided which is fastened to the upper bush 6 and drilled with two openings 31, 31' allowing passage for two burners 32, 32'. This cap 29 fits over the casting space, isolates it from the ambient atmosphere and heats the internal space of the nozzle 39 before and possibly during the cast. Here, the channel 27 filled with sand 28, which receives the falling edge of the cap 29, bears on the side walls 38, 38' via vertical supports 47, 47'. Fixed under this channel 27, vertically in line with the rolls 36, 36', are shoes 48, 48' whose lower surfaces match the shape of the external surface of the rolls 36, 36' and are at most a few mm away therefrom. Preferably, an inert gas is blown in through these shoes 48, 48' into the spaces 49, 49' separating them from the rolls 36, 36', so as to form a gaseous barrier to the penetration of air into the space around the mold.

Figure 3A:
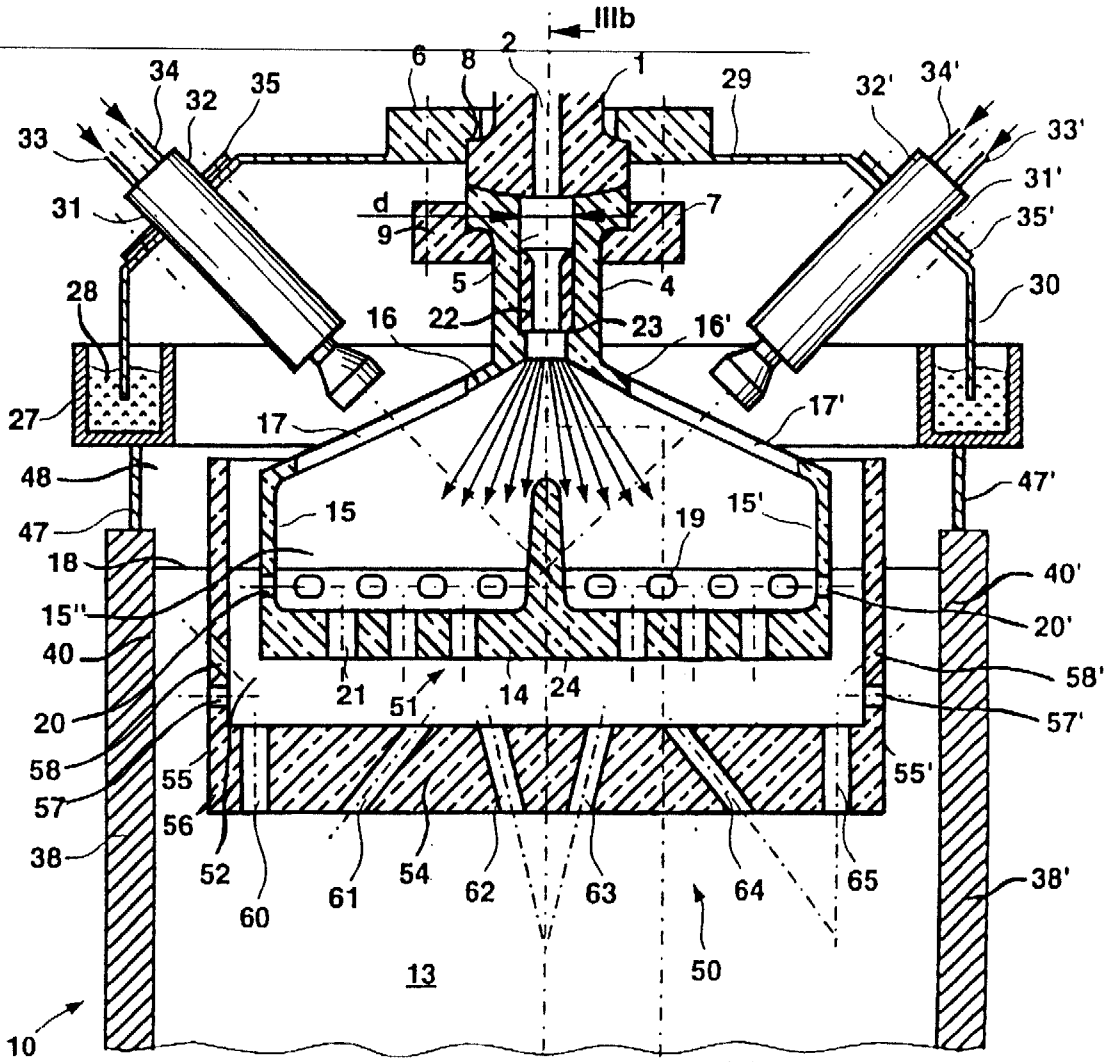
FIGS. 3*a* and 3*b* which show, seen in section on IIIa—IIIa and IIIb—IIIb respectively, another example of a nozzle according to the invention, as well as the mold and the environment of the mold of the twin-roll thin-strip caster thus equipped.
Figure 3B:
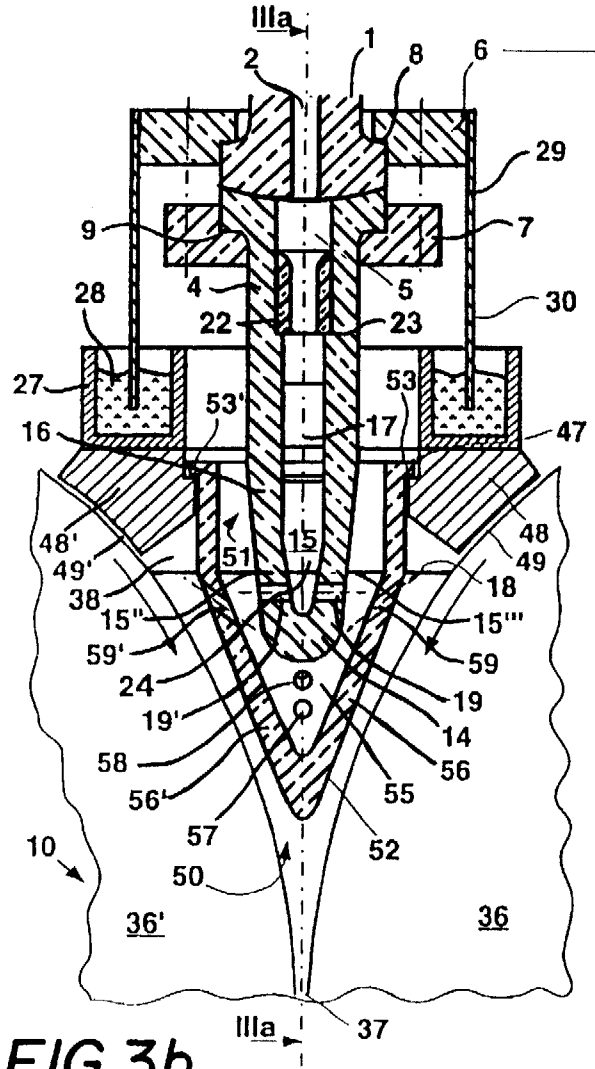

Another example of a nozzle 50 according to the invention is depicted in FIGS. 3*a* and 3*b*. This nozzle, like the previous nozzle 39, is especially adapted to the twin-roll casting of thin strip. It is built into a device for inerting the casting space 13, similar to the one described previously and depicted in FIGS. 2*a*, 2*b*. This nozzle 50 is formed by two separate parts.

The first part 51 is made like a nozzle of the nozzle 3 type, depicted in FIGS. 1*a*, 1*b*, but with a few modifications:

- the chimney 4 may be shortened, so that the bottom 14 is submerged only a relatively shallow depth in the liquid metal during casting; consequently, the outlets 19, 19', 20, 20' made in the lateral walls 15, 15', 15", 15''' are located just above the bottom 14, so as to remain submerged when the surface of the liquid metal is at its usual level during the cast;
- instead of being constant, the thickness of this first part 51 decreases slightly in its terminal portion, so as to follow the progressive narrowing of the casting space 13.

The second part of the nozzle 50 is formed by a basket 52 surrounding the lower portion of the first part 51 at some distance therefrom. It bears on bearing surfaces 53, 53' provided on the shoes 48, 48'. In its lower part, there is also a narrowing, so that it can match the shape of the casting space 13 and can maintain a roughly uniform distance between each of its outer walls and the roll 36, 36' which it faces. Thus, the liquid metal leaving the first part 51 of the nozzle 50, instead of flowing directly into the casting space 13, passes firstly into the basket 52. It leaves this via a series of outlets made in the bottom 54 and the lateral walls 55, 55', 56, 56' of the basket 52. The outlets 57, 57', 58, 58' direct the liquid metal to the side walls 38, 38', the outlets 59, 59' direct it to the rolls 36, 36' and the outlets 60, 61, 62, 63, 64, 65 direct it to the bottom of the casting space 13. For this purpose, provision may be made for two adjacent outlets in the bottom 54 to direct the liquid metal in convergent flows, so that the streams impinge on each other. This results in a diffuse flow of the metal, thus avoiding local impacts on the solidified shell which would lead to it being reheated or even to it melting again. Of course, it is also possible to provide this type of arrangement for the bottoms 14 of the nozzles 3 and 39 which have been previously described and depicted in FIGS. 1*a*, 1*b* and 2*a*, 2*b*. The surface of the liquid metal is at the same level 18 (excepting head losses) in the internal volume of the first part 51 of the nozzle 50, in the basket 52 and in the casting space 13.

The use of such a basket 52 has several advantages. It constitutes an additional energy absorber, therefore better stabilizing the flows of liquid metal in the casting space 13 and damping out the fluctuations in the level 18 of its surface, all this tending to improve the quality of the products cast. Moreover, it makes it possible to retain a large part of the nonmetallic inclusions and various impurities present in the liquid metal flowing out of the tundish: it is thus possible to cast products with superior cleanliness. However, on the other hand such a basket 52, were it to be used on a nozzle of the usual type, would impair the preheating of the nozzle since it would make the bottom 14 of the first part 51 of the nozzle which it surrounds inaccessible, after assembly, from the outside. However, because of the increase in total mass of refractory which would result from the use of a basket 52, the proper execution of such preheating would be of even more importance. The combination of a basket 52 with a nozzle 50 according to the invention makes it possible to solve this problem. This is because the presence of the openings 17, 17' gives access to the bottom 14 of the first part 51, even after assembling the nozzle 50. This first part 51 can therefore be heated by the burners 32, 32' both before and, should it be desired, during the cast. As a variant, it may be imagined to rest the basket 52 on parts of the machine other than the shoes 48, 48', or indeed on the first part 51 of the nozzle. It is possible, in particular, to adopt this solution when the nozzle 50 has to be used on a conventional plant for the continuous casting of slabs.

Another advantage of the nozzles 3, 39, 50 according to the invention is that the presence of the openings 17, 17' therein makes it possible to introduce addition elements, either in the form of solid materials or of gas. This introduction, as shown in FIG. 1*a*, may be carried out by virtue of pipes 66, 66' passing through the cap 29, the lower end of which pipes sits over the openings 17, 17'. Through these pipes 66, 66' (which, outside the periods of addition of materials, must be closed off or, optionally, be used for blowing in an inerting gas) may be introduced solid materials in the form of powder, granules, wire or covered wire, or small-diameter lances making it possible to sparge gas into the liquid metal. These same pipes 66, 66' (or other similar ones arranged beside them) may also serve to introduce measurement instruments into the nozzle 3, such as means for measuring the temperature of the liquid metal or its dissolved-oxygen content, or a probe for taking gas samples enabling the proper inerting of the atmosphere in the nozzle 3 to be verified. It is also possible via these pipes 66, 66' to introduce means for taking samples of liquid metal, such as glass tubes under vacuum. The other types of nozzles described and depicted may also be equipped with such pipes 66, 66', or with functionally equivalent devices. In order to guarantee good distribution of these additions inside the nozzle 3, 39, 50, it is preferable to employ two pipes 66, 66' rather than just one, in particular in the case where a partition 24 is used. There is thus the possibility of making micro-additions of alloy elements at a late stage in the smelting, ensuring superior homogeneity of these additions than if they were carried out in the mold. In addition, the possibility of reheating the metal during the cast, by virtue of the burners 32, 32', at the very point where these additions are made, makes it possible to compensate effectively for any possible endothermic effect they have on the liquid metal. As is known, the purpose of these microadditions may be to bring about, especially, a fine adjustment to the composition of the metal, an improvement in its solidification conditions and modifications to the composition and to the morphology of the nonmetallic inclusions.

Another advantage of the nozzles 3, 39, 50 according to the invention is that the openings 17, 17' make it easy to manufacture them as a single piece by hot isostatic pressing of the refractory material of which they are composed, including when it is desired to give them a complex internal shape. This pressing is usually carried out around a core made of one or more pieces, which must subsequently be able to be removed without damaging the nozzle. The openings 17, 17' in the nozzles according to the invention allow precise removal, in succession, of the various pieces of which the core is composed. However, the construction of the entire nozzle according to the invention as a single piece is not mandatory and it is possible to arrange to produce the nozzle in several parts which are assembled one after the other before installing the nozzle on the tundish, or at the time of installing it.

Of course, without departing from the spirit of the invention, it is possible to provide alternative forms to the configurations of the nozzles and of their surroundings which have been described and depicted. In particular, other means may be used to ensure that the nozzle and the casting space are sealed off from the external air. Moreover, in some cases, the presence of a single reheating device (and therefore of a single opening 17, 17') may be deemed to be sufficient if the orientation and the power of the device and the internal configuration of the nozzle allow, in any case, suitable reheating of all the liquid metal passing through the nozzle. Greater trapping of the inclusions may thus be possible by inserting inclusion filters, such as porous elements made of refractory, in at least some of the outlets. Finally, it is also conceivable to dispense with the cap 29 and with its appended elements, and to fix the burners 32, 32' directly on the terminal part of the nozzle 3, 39, 50, via their collars 35, 35', thus ensuring that the collar 35, 35'/nozzle 3, 39, 50 connections are properly sealed when the nozzle 3, 39, 50 is in use. It is then necessary for the terminal part of the nozzle 3, 39, 50 to be equipped with means enabling the burners 32, 32' to be fixed. As previously, it is conceivable that the burners 32, 32' act only during the phase of preheating the nozzle 3, 39, 50 (in which case, during the cast, they may be replaced by covers blocking off the openings 17, 17'), or that they also operate during the cast itself. If it is desired to be able to make microadditions actually inside the nozzle, it is then necessary for the pipes 66, 66' to pass through the wall of the nozzle 3, 39, 50 itself.

We claim:

1. A nozzle for introduction of a liquid metal into a mold for the continuous casting of metal products, comprising a chimney having an upper end connectable by affixing means to an output nozzle of a vessel containing said liquid metal, and a lower end, and a terminal part connected to said lower end of said chimney and provided with outlets for distributing said liquid metal in a casting space defined by said mold, wherein said terminal part includes, in its upper region, at least one opening means for conducting heat to the inside of said terminal part from a heating means to maintain said metal in a liquid state in said terminal part.

2. The nozzle as claimed in claim 1, including at least two opening means and a partition disposed in the inside of said terminal part lying vertically in line with said chimney and separating said inside into two compartments, each of which lies vertically in line with one of said opening means.

3. The nozzle as claimed in claim 1, wherein said terminal part is surrounded by a basket provided with outlets for passage of the liquid metal into the casting space.

4. The nozzle as claimed in claim 1, further comprising means for fixing said heating means to said terminal part of the nozzle.

5. The nozzle as claimed in claim 1, further comprising means for the introduction of instruments or of means for taking a sample of liquid metal from inside said terminal part of the nozzle.

6. The nozzle as claimed in claim 1, further comprising an insert for locally restricting the passage of the liquid metal in the chimney.

7. A plant for the continuous casting of metal products, including a bottomless mold having intensively internally cooled walls defining a casting space, and a nozzle made of refractory material having an upper end which is connected to a vessel containing a liquid metal, and a lower end for feeding said liquid metal into said casting space, wherein said nozzle includes the structure recited in claim 1.

8. The continuous casting plant as claimed in claim 7, including a cap sitting over said casting space, said cap being provided with at least one opening for insertion of a heating means, and means for directing said heating means towards one of said opening means in said nozzle.

9. The continuous casting plant as claimed in claim 8, further comprising means for introducing measuring instruments or means for taking a sample of liquid metal from inside said terminal part of said nozzle, said introducing means passing through said cap.

10. The continuous casting plant as claimed in claim 8, wherein said cap is fastened to said affixing means for fastening said chimney to said output nozzle of the vessel containing the liquid metal.

11. The continuous casting plant as claimed in claim 7, including a basket provided with outlets for the liquid metal, said basket surrounding the terminal part of the nozzle.

12. The continuous casting plant as claimed in claim 7, wherein said plant is adapted to the continuous casting of a slab of metal.

13. The continuous casting plant as claimed in claim 7, wherein said plant is adapted to the continuous casting of metal strip directly from liquid metal.

14. The continuous casting plant as claimed in claim 13, wherein said plant is a twin-roll casting plant.

15. A nozzle for introduction of a liquid metal into a mold for the continuous casting of metal products, comprising a chimney having an upper end connectable by affixing means to an output nozzle of a vessel containing said liquid metal, and a lower end;

a terminal part connected to said lower end of said chimney and provided with outlets for distributing said liquid metal in a casting space defined by said mold, where said terminal part includes, in its upper region, at least one opening means for conducting heat to the inside of said terminal part from a heating means to maintain said metal in a liquid state in said terminal part, and a cap means disposed over said opening means for preventing ambient air from entering the inside of said terminal part.

* * * * *